US010570674B1

(12) United States Patent
Bair et al.

(10) Patent No.: US 10,570,674 B1
(45) Date of Patent: Feb. 25, 2020

(54) ROD STRING LATCHING TOOL WITHOUT INTEGRAL RELEASE MECHANISM AND METHOD FOR USE OF SAME

(71) Applicant: Black Gold Pump and Supply, Inc., Signal Hill, CA (US)

(72) Inventors: Michael Bair, Los Angeles, CA (US); Simon Shin, Los Angeles, CA (US); Kenneth Barbera, Los Angeles, CA (US)

(73) Assignee: Black Gold Pump and Supply, Inc., Signal Hill, CA (US)

( * ) Notice: Subject to any disclaimer, the term of this patent is extended or adjusted under 35 U.S.C. 154(b) by 49 days.

(21) Appl. No.: 16/117,393

(22) Filed: Aug. 30, 2018

(51) Int. Cl.

| | |
|---|---|
| ***E21B 17/046*** | (2006.01) |
| ***E21B 17/042*** | (2006.01) |
| ***F04B 53/14*** | (2006.01) |
| ***E21B 43/12*** | (2006.01) |

(52) U.S. Cl.
CPC ..... *E21B 17/046* (2013.01); *E21B 17/0423* (2013.01); *F04B 53/144* (2013.01); *E21B 43/127* (2013.01); *E21B 2043/125* (2013.01)

(58) Field of Classification Search
CPC .. E21B 17/046; E21B 17/0423; E21B 43/127; E21B 43/125; F04B 53/144
See application file for complete search history.

(56) References Cited

U.S. PATENT DOCUMENTS

| | | | | | |
|---|---|---|---|---|---|
| 1,645,428 | A | * | 10/1927 | Hosmer | E21B 17/046 403/305 |
| 2,266,344 | A | * | 12/1941 | Staerker | E21B 17/046 403/316 |
| 2,671,682 | A | * | 3/1954 | Page | E21B 17/046 403/11 |
| 3,168,340 | A | * | 2/1965 | Howard | E21B 17/046 403/182 |
| 3,219,373 | A | * | 11/1965 | Sutliff | E21B 17/046 403/34 |
| 3,275,354 | A | * | 9/1966 | Sutliff | E21B 17/046 403/11 |
| 3,366,408 | A | * | 1/1968 | Scarborough | F16B 2/16 403/34 |
| 3,455,248 | A | * | 7/1969 | Sutton | F04B 53/04 403/24 |

(Continued)

*Primary Examiner* — Nicole Coy
(74) *Attorney, Agent, or Firm* — James M. Duncan, Esq.; Klein DeNatale Goldner

(57) ABSTRACT

In an oilwell produced by a downhole pump operated by the reciprocation of a string of rods disposed within a string of tubing, a system connects an upper section of the string of rods to a plunger assembly. The system has an upper mechanism attached to the upper section of the string of rods, where the upper mechanism has a housing member having an internal bore section having an approximate inverted conical profile. The upper mechanism has a slip member which is configured to be received into the inverted conical profile. A lower mechanism attaches to the plunger assembly. The lower mechanism has an upward end comprising a pin which, upon engagement by the upper mechanism, is received into the slip member and firmly retained within the slip member. Once the pin is engaged within the slip member, the pin is retained within the slip member until it can be manually released.

21 Claims, 3 Drawing Sheets

(56) References Cited

U.S. PATENT DOCUMENTS

| | | | | |
|---|---|---|---|---|
| 7,438,125 | B2 * | 10/2008 | Victor | E21B 43/127 166/105.2 |
| 10,018,000 | B2 * | 7/2018 | Ford | E21B 17/046 |
| 10,273,762 | B2 * | 4/2019 | Stachowiak | E21B 17/046 |
| 2014/0110130 | A1 * | 4/2014 | Lembcke | E21B 43/126 166/378 |

* cited by examiner

ROD STRING LATCHING TOOL WITHOUT INTEGRAL RELEASE MECHANISM AND METHOD FOR USE OF SAME

BACKGROUND OF THE INVENTION

The use of on and off tools (or on-off tools) for connecting and disconnecting portions of a rod string is known in the petroleum industry. In the typical application, the on and off tool is used to prevent stripping jobs. A stripping job is required when a downhole pump or plunger cannot be unseated from the tubing string. In such cases, unless the rod string can be otherwise disconnected from the pump or plunger, the tubing string and rod string are pulled together, with the tubing "stripped" over the rod string. However, with an on and off tool, the section of the rod string above the tool may be released by activating the tool, leaving the section of the rod string below the tool in the tubing. In this application, the primary purpose of the on and off tool is the "off" function.

However, in some applications, the primary purpose of the on and off tool is the "on" function, where it is desirable to be able to connect an upper section of rods to a lower section of rods previously installed within a tubing string. For example, if the plunger of a downhole pump has a larger diameter than the drift diameter of the tubing, the plunger assembly having a lower portion of the on-off tool attached, will be installed in the well as the tubing string is installed. Once the tubing string is in place, an upper section of the rod string is run into the well, where the lower most rod of the upper section has the upper portion of the on-off tool attached to it. The upper portion of the tool engages the lower portion, thereby connecting the upper section of the rod string to the lower section of the rod string. When servicing is required, the tool is clutched, rotated, and un-latched so that the rod string can be retrieved to surface while the plunger assembly remains down-hole with the tubing.

The currently known on-off tools have in a small gap between a housing member in the upper portion of the tool and a bushing in the lower portion of the tool. Reciprocating motion during pump operation causes the gap to close and to open every cycle. Under certain well conditions, this phenomenon can cause the on-off tool to prematurely un-latch such that the lower portion of the rod string is separated from the upper portion of the rod string. A premature release of the on-off tool causes downtime and a significant monetary loss because a crane or work-over rig, at significant expense, is required to re-engage the on-off tool. During the period the on-off tool is disengaged well production is lost. Moreover, if this event happens once, it's likely that it will happen repeatedly on the same well. There is currently no known solution to this problem.

SUMMARY OF THE INVENTION

Embodiments of the present invention solve the above identified problem by providing a rod string connection device which only performs the "on" function described above, and does not perform the "off function". In other words, the present invention does not have an integral release mechanism. The inventors herein refer to this invention as an "on only" tool. If it is necessary to separate the lower section of the rod string from the upper section of the rod string, other non-integral mechanisms may be used to make the separation, such as a coupling having left-handed threads or a shear coupling.

One embodiment of the system for connecting an upper section of a string of rods to a plunger assembly has an upper mechanism and a lower mechanism.

The upper mechanism has a housing member having an upper end and a lower end, where the upper end has upper internal threads and the lower end has lower internal threads. An internal smooth bore section is disposed between the upper internal threads and the lower internal threads. The internal smooth bore section may have an approximate inverted conical profile. A connector is configured to attach to the upper section of the string of rods, where the connector has a top end and a bottom end. The top end has a connection for connecting to the upper section, where the connection may either be a male pin connector or a female box connection. The bottom end of the connector has external threads configured to attach to the upper internal threads of the housing member. The connector may also have an external circumferential shoulder disposed between the top end and the bottom end. The upper mechanism also has an internal slip member. The slip member has an external profile which is approximates an inverted cone. The slip member is configured so that it will engage the approximate inverted conical profile of the internal smooth bore section of the housing member. When the upper mechanism is in an assembled configuration, with the connector made up to the upper end of the housing member, a biasing member, such as a spring, is disposed between the bottom end of the connector and the slip member.

The lower mechanism or bushing member which has an upward end having, with respect to the well orientation, an upwardly facing pin and a downward end which has threads—either internal or external—which are configured to attach to the plunger assembly. The bushing member also has an intermediate section having threads configured to make up to the lower internal threads of the housing member. The upwardly facing pin is configured to be received and retained within the slip member of the upper mechanism when the upper mechanism engages the lower mechanism, and the external threads of the bushing thereafter making up to the lower internal threads of the housing member as the upper mechanism is attached to the lower mechanism. The connector may have axially-aligned bore through its center which centralizes the upwardly facing pin as it is inserted into the housing member.

It is to be appreciated that the present invention may be utilized for a variety of purposes and in a variety of locations to attach an upper portion of the rod string to a lower portion of the rod string. Typically the connector attaches to a lowermost rod of the upper section, but could attach to other tools utilized within the rod string, to a pony rod, to the polish rod. The downward end of the lower mechanism may attach to the uppermost rod of the lower section of rods, or it may attach directly to a valve rod bushing on the valve rod of a pump plunger.

In some embodiments of the invention, the connector may have a port which prevents hydraulic locking which might otherwise occur when the upwardly facing pin is received within the slip member. The port may extend from an interior wall of the connector to an exterior wall of the connector.

A seat member may be disposed between the biasing member and the slip member, where the seat member provides a positive engagement between the biasing member and the slips. Otherwise, the biasing member may shift which can cause the slips to unevenly grip the upwardly facing pin of the bushing.

The internal slip member may be configured to have a plurality of vertical sections, for example three sections each describing an arc of 120 degrees. The interior surface of the internal slip member may have a plurality of serrations, which provide a gripping surface for the surface of the upwardly facing pin of the bushing member.

The components of embodiments of the invention may be configured to facilitate the receiving for the upwardly facing pin within the housing member. For example, the upwardly facing pin may have a beveled tip and the lower end of the housing member may be beveled inwardly, such that the housing member is guided over the upwardly facing pin as the tool is lowered into the well on the end of upward section of the rod string.

Embodiments of the present invention also provide a method for connecting an upper section of a rod string to a plunger assembly. In the method, a string of tubing is installed into an oil well, where a plunger assembly is disposed within the tubing, and a lower mechanism of rod connection system as described herein is attached to the plunger assembly. An upper mechanism of a rod connection system as described herein is attached to an upper section of the rod string and lowered into the well until the internal slip mechanism slides over the upwardly facing pin of the lower mechanism. The upper section of the rod string is thereafter rotated causing the external threads of the lower mechanism to make up to the threads of the housing member.

DETAILED DESCRIPTION OF THE INVENTION

The following description may utilize such directional terms as "upper," "lower," "inner," "outer," "inside," "outside," etc. The use of such terms is made with respect to orientation of the figures submitted herewith and as understood with respect to the orientation of an oilwell and the production equipment utilized in an oilwell. However, it is to be understood that such terms may have a different orientation in an actual installation, such that the use of such terms are not to be understood to limit the claimed invention to those particular orientations.

Figure 1:
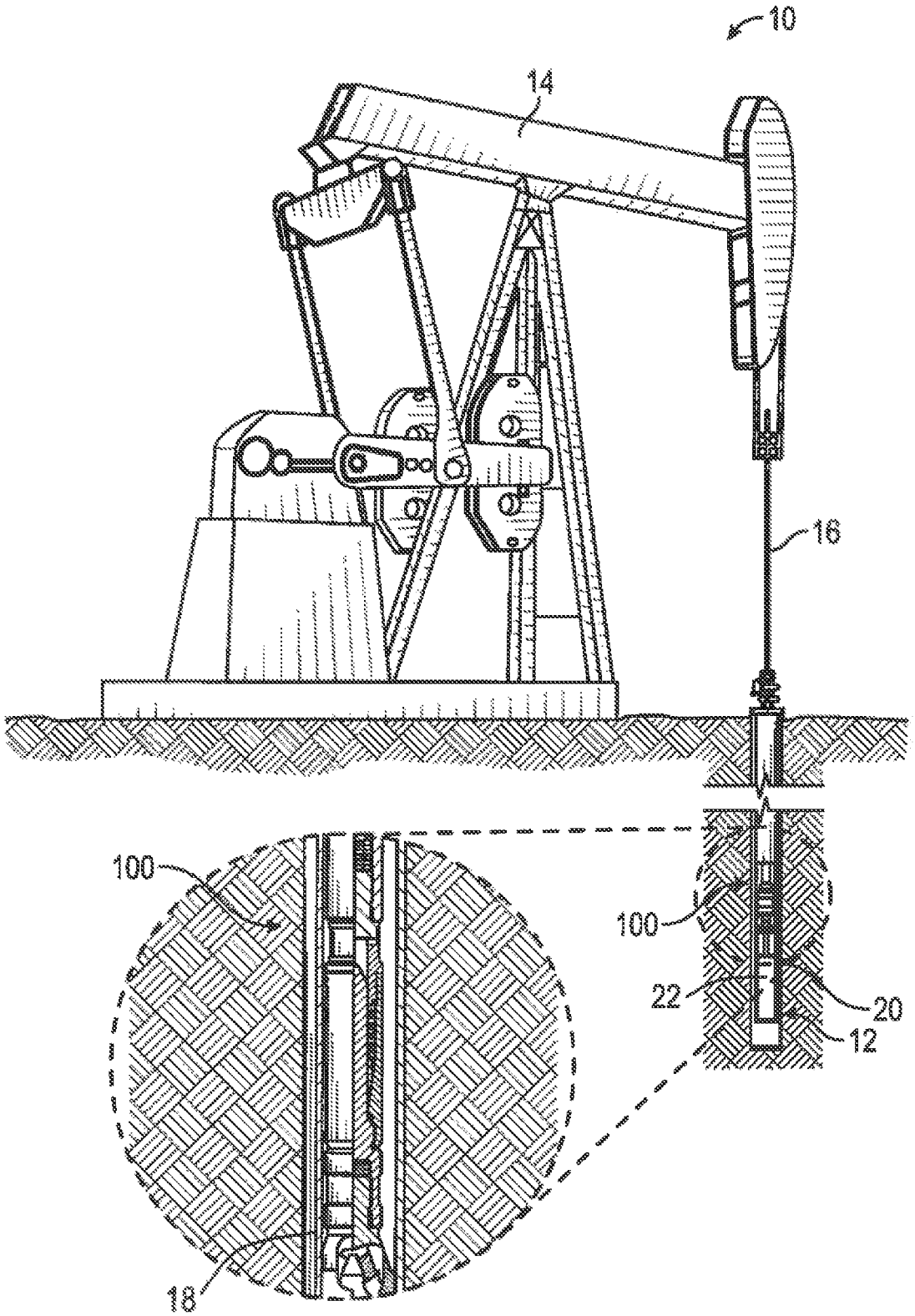
FIG. 1 schematically depicts an oilwell production system in which a subsurface pump is actuated by a surface pumping unit by a string of rods.

Referring now to the figures, FIG. 1 schematically depicts an oilwell production system 10 in which a subsurface pump 12 is actuated by a surface pumping unit 14 by a string of rods 16 which are reciprocated up and down inside of tubing string 18 by the linear motion imposed by the surface pumping unit 14. Fluid is received into the subsurface pump 12 and by action of the plunger 20 reciprocating within pump barrel 22, the fluid is displaced into tubing string 18 and lifted to the surface. FIG. 1 shows an embodiment of the presently disclosed system 100 for connecting an upper section of the string of rods 16 to plunger 20 disposed immediately above the subsurface pump 12. However, embodiments of the disclosed system 100 may be placed at any position between an upper section of the string of rods and a lower section of the string of rods.

Figure 2:
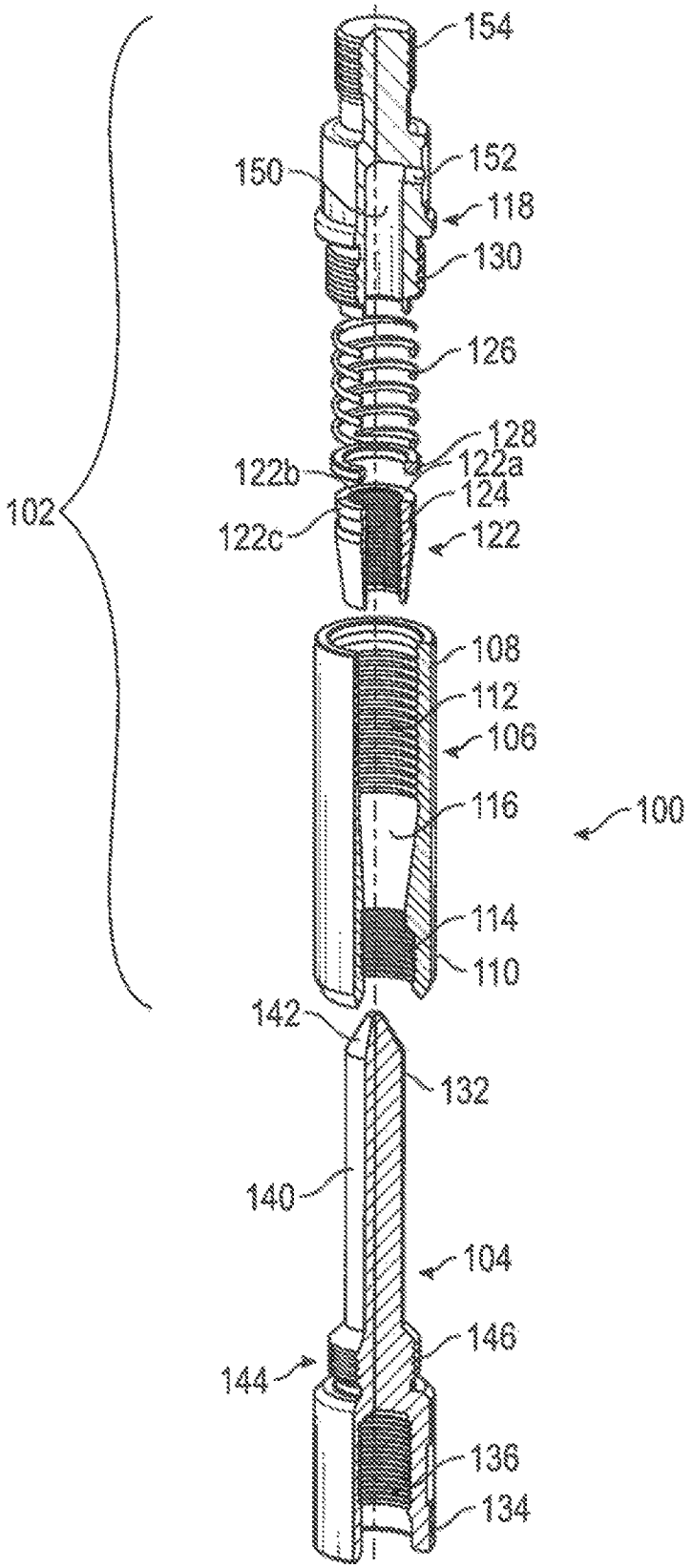
FIG. 2 depicts an exploded view of an embodiment of the system for connecting an upper section of the string of rods to a plunger assembly.

FIG. 2 depicts an exploded view of an embodiment of the disclosed system 100. The disclosed system has an upper mechanism 102 and a lower mechanism 104. The upper mechanism 102 has a housing member 106 having an upper end 108 and a lower end 110. Upper end 108 may have upper internal threads 112 and lower end 110 may have has lower internal threads 114. A smooth bore section 116 is disposed between the upper internal threads 112 and lower internal threads 114. The internal smooth bore section 116 may have an approximate inverted conical profile, having a relatively large diameter at the top of the smooth bore section 116 and having a relatively smaller diameter at the bottom of the smooth bore section. In any embodiment, the internal profile of the internal smooth bore section 116 will be configured so as to provide a seat for slip member 122

Slip member 122 may comprise a plurality of vertical sections 122*a*, 122*b*, and 122*c*. Each vertical section may describe an arc of 120 degrees. As indicated in FIG. 2, the interior surface 124 of slip member 122 may have a serrated surface. Slip member 122 is positioned within smooth bore section 116 of housing member 106 by the urging of biasing member 126 which may be a spring as indicated in FIG. 2, or other biasing mechanism, such as a piston or elastically deformable spacer. A seat 128 may be positioned between biasing member 126 and slip member 122 to provide a positive engagement between the biasing member and the slip member to prevent shifting between the slip member and the biasing member.

The upper mechanism 102 further comprises a connector 118 which is configured to attach to the upper section 120 of the string of rods 16. Connector 118 may comprise external threads 130 which make up to upper internal threads 112 of housing member 106. In addition, connector 118 may have an axially-aligned bore 150 which centralizes pin 140 as it is inserted into the housing member. Connector 118 may also have a port 152 which prevents hydraulic locking which may occur as pin 140 of the lower mechanism 104 enters the axially-aligned bore 150. Port 152 extends from an interior wall of the connector 118 to an exterior wall as indicated in FIG. 2. Connector 118 has an upper connection end 154 which is threaded to receive a rod coupling which connects the upper mechanism 102 to the upper section of the rod string 120.

When the upper mechanism 102 is assembled, it is assembled as depicted in FIG. 2, with the slip member 122 being urged into smooth bore section 116 by biasing member 126, with seat 128 disposed between the slip member and the biasing member. Connector 118 is made up to the upper internal threads 112 of the housing member.

Lower mechanism 104 (also referred to as a bushing member) has an upward end 132 and a downward end 134. Downward end 134 comprises threads 136, which are shown as internal threads in FIG. 2, but which may be configured as either external or internal. Threads 136 are configured to attach to the plunger assembly 138 or to a sucker rod, pony rod or other device connected to the plunger assembly 138. The upward end 132 of the lower mechanism has a pin 140 which is sized to be received within the slip member 122. Pin 140 may have a beveled or tapered tip 142 which facilitates entry of the pin into the lower end 110 of housing member 106 and into slip member 122. Likewise, the lower end 110 of housing member 106 may be beveled inwardly to facilitate entry of the pin. Lower mechanism 104 also has an intermediate section 144. Intermediate section 144 has threads 146 which are configured to make up to lower internal threads 114 of the upper mechanism 102.

Figure 3:
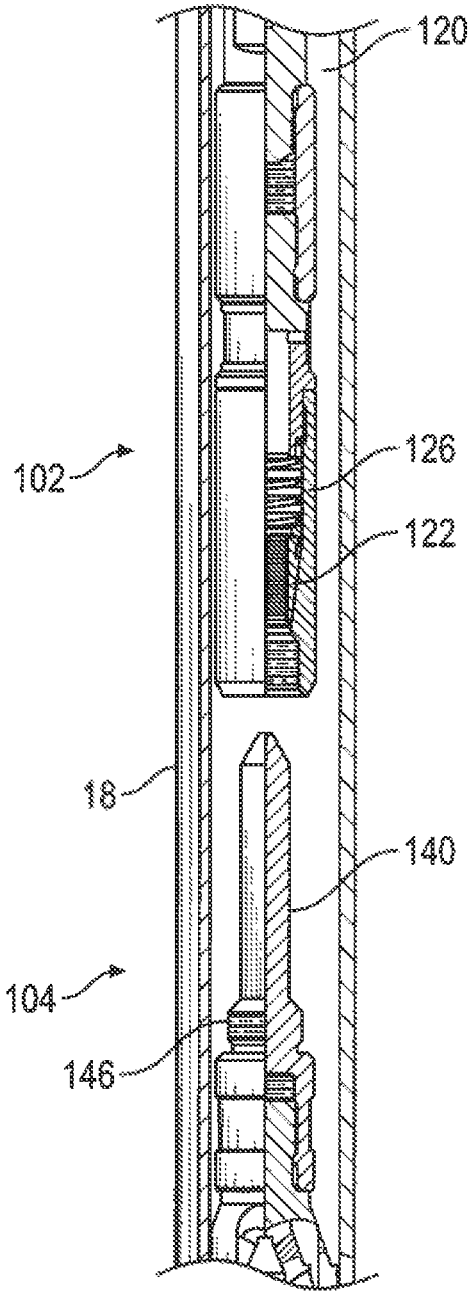
FIG. 3 depicts an embodiment of the system for connecting an upper section of the string of rods to a plunger assembly, showing the system prior to the engagement of the upper mechanism with the lower mechanism.
Figure 4:
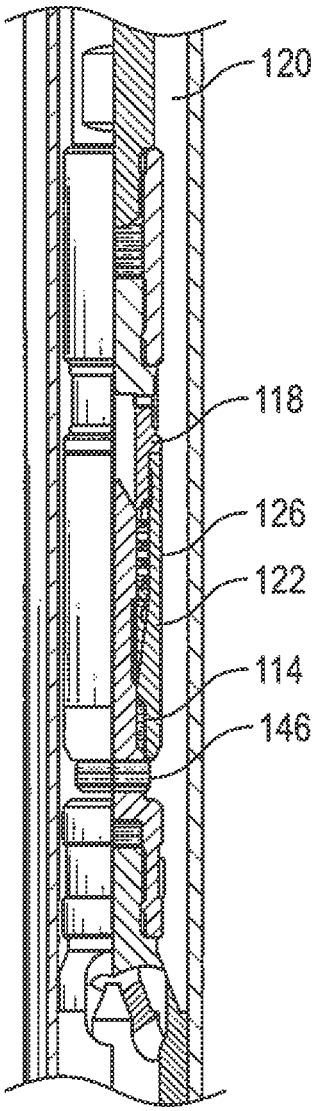
FIG. 4 depicts an embodiment of the system for connecting an upper section of the string of rods to a plunger assembly, showing the system after the upwardly facing pin has been received within the slip member but before the upper mechanism has been fully made up to the lower mechanism.
Figure 5:
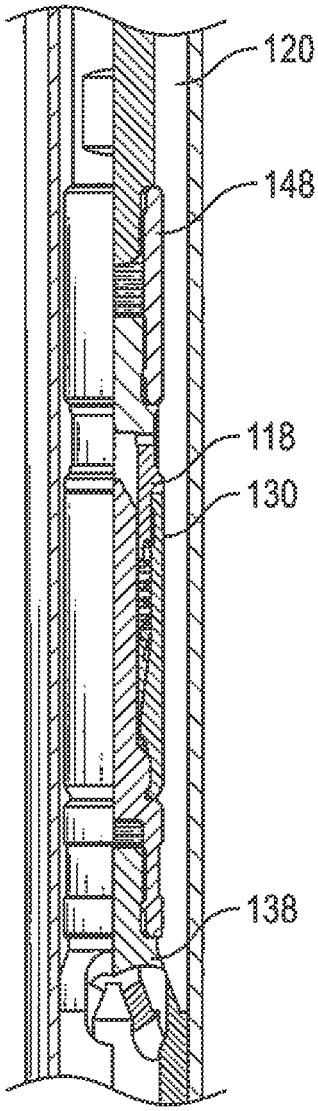
FIG. 5 depicts an embodiment of the system for connecting an upper section of the string of rods to a plunger assembly, after the upper mechanism has been fully made up to the lower mechanism.

FIGS. 3-5 show an embodiment of the disclosed system 100 in operation. FIG. 3 depicts the system as the upper mechanism 102 is lowered into the oil well on the string of rods 16 and is prepared to engage lower mechanism 104. FIG. 4 shows the disclosed system after pin 140 has been received by slip member 122, but before the lower threads 114 of lower end 110 of housing member 106 are made up onto threads 146 of lower mechanism 104, in what is referred to as a "pre-engaged" configuration. FIG. 5 depicts the disclosed system after lower threads 114 are made up onto threads 146 by rotation of the rod string into an "engaged" configuration. The completion of these stages will allow the string of rods 16 to be properly engaged to the plunger 20 while eliminating the possibility of the tool prematurely unlatching. If there is counter-clockwise rotation of the rod string, the slip member 122 will move further down the housing member 106, which allows the slip member 122 to hold more efficiently because of the inverted conical profile within the bore of the housing member. Because the present invention only allows connecting to the plunger assembly—and does not allow for disconnecting—a shear coupling 148 or left-hand threaded coupling may be provided in the string of rods 16 above the system 100 to allow the ability to disconnect the upper section of rods from the plunger assembly.

Having thus described various embodiments of the invention, including the preferred embodiment, what is claimed as new and desired to be protected by Letters Patent includes the following:

1. In an oilwell produced by a downhole pump operated by the reciprocation of a string of rods disposed within a string of tubing, a system for connecting an upper section of the string of rods to a plunger assembly wherein the system comprises an upper mechanism and a lower mechanism, wherein the upper mechanism comprises:

a housing member having an upper end and a lower end, the upper end comprising upper internal threads and the lower end comprising lower internal threads, the housing member further comprising an internal smooth bore section disposed between the upper internal threads and the lower internal threads, the internal smooth bore section comprising an inverted truncated conical profile;

a connector configured to attach to the upper section of the string of rods, the connector comprising a top end and a bottom end, the top end comprising a threaded pin for connecting to the upper section and the bottom end comprising external threads configured to attach to the upper internal threads of the housing member, the connector further comprising an external circumferential shoulder disposed between the top end and the bottom end;

a slip member having an external profile comprising an inverted truncated conical profile, the slip member configured to engage the inverted truncated conical profile of the internal smooth bore section of the housing member;

a biasing member;

wherein, in an assembled configuration, the slip member is disposed within the internal smooth bore and the connector is made up to the upper end of the housing member, with the biasing member disposed between the bottom end of the connector and the slip member; and the lower mechanism having an upward end comprising a pin and a downward end comprising threads configured to attach to the plunger assembly, the lower mechanism further comprising an intermediate section comprising external threads configured to make up to the lower internal threads of the housing member, wherein the pin is configured to be received and retained within the slip member of the upper mechanism when the upper mechanism engages the lower mechanism, and the external threads thereafter made up to the lower internal threads of the housing member.

2. The system of claim 1 wherein the connector attaches to a lowermost rod of the upper section.

3. The system of claim 1 wherein the downward end of the lower mechanism attaches to an uppermost rod attached to the plunger assembly.

4. The system of claim 1 wherein the connector comprises a port which extends from an interior wall of the connector to an exterior wall of the connector.

5. The system of claim 1 wherein the upper section comprises a rod coupling comprising left-handed threads.

6. The system of claim 1 wherein a shear coupling connects the lowermost rod of the upper section of the string of rods to the threaded pin of the connector.

7. The system of claim 1 further comprising a seat disposed between the biasing member and the slip member.

8. The system of claim 1 wherein the slip member comprises a plurality of vertical sections.

9. The system of claim 1 wherein the slip member comprises an interior surface comprising a plurality of serrations.

10. The system of claim 1 wherein the pin comprises a beveled tip.

11. The system of claim 1 wherein the lower end of the housing member is beveled inwardly.

12. A method for connecting an upper section of a rod string to a plunger assembly in an oil well comprising the steps of:

installing a string of tubing into the oil well, wherein the string of tubing comprises the plunger assembly, wherein a lower mechanism of a rod connection system is attached to the plunger assembly, wherein the lower mechanism comprises a downward facing end attached to the plunger assembly, the lower mechanism further comprising an upward facing end comprising a pin and an intermediate section between the downward facing end and the pin, the intermediate section comprising threads;

attaching an upper mechanism to the upper section of the rod string, wherein the upper mechanism comprises a housing member having an internal slip mechanism adapted to receive and grasp the pin of the lower mechanism, wherein the internal slip mechanism does not release the pin until after the housing member is pulled out of the well, the housing member further comprising threads configured to make up to the threads of the intermediate section;

lowering the upper mechanism until the internal slip mechanism slides over the pin; and rotating the upper section of the rod string causing the threads of the intermediate section to make up to the threads of the housing member.

13. The method of claim 12 wherein the housing member comprises an upper end and a lower end, the housing member further comprising an internal smooth bore section disposed between the upper end and the lower end, the internal smooth bore section comprising an inverted truncated conical profile, wherein the internal slip mechanism is disposed within internal smooth bore section.

14. The method of claim 12 wherein the upper mechanism comprises a connector configured to attach to a lowermost rod of the upper section of the string of rods, the connector comprising a top end and a bottom end, the top end comprising a threaded pin for connecting to the lowermost rod and the bottom end comprising external threads configured to attach to the upper end of the housing member, the connector further comprising an external circumferential shoulder disposed between the top end and the bottom end.

15. The method of claim 14 wherein, in an assembled configuration the internal slip mechanism is disposed within the internal smooth bore section and a biasing member is disposed between the bottom end of the connector and the internal slip mechanism.

16. The method of claim 14 wherein the connector comprises a port which extends from an interior wall of the connector to an exterior wall of the connector.

17. The method of claim 14 wherein a shear coupling connects the lowermost rod of the upper section to the threaded pin of the connector.

18. In an oilwell produced by a downhole pump operated by the reciprocation of a string of rods disposed within a string of tubing, a system for connecting an upper section of the string of rods to a plunger assembly, the system comprising:

a lower mechanism attached to the plunger assembly, wherein the lower mechanism comprises a downward facing end attached to the plunger assembly, the lower mechanism further comprising an upward facing end comprising a pin and an intermediate section between the downward facing end and the pin, the intermediate section comprising external threads; and an upper mechanism comprising a housing member attached to the upper section of the string of rods, the housing member comprising an internal slip mechanism adapted to receive and grasp the pin of the lower mechanism, wherein once the internal slip mechanism has received the pin, the pin is retained until the housing member is removed from the oilwell.

19. The system of claim 18 wherein the housing member comprises an upper end and a lower end, the upper end comprising upper internal threads and the lower end comprising lower internal threads, the housing member further comprising an internal smooth bore section disposed between the upper internal threads and the lower internal threads, the internal smooth bore section comprising an inverted truncated conical profile.

20. The system of claim 19 wherein the internal slip mechanism comprises an inverted truncated conical profile, the internal slip mechanism configured to engage the inverted truncated conical profile of the internal smooth bore section.

21. The system of claim 20 wherein the external threads of the intermediate section are configured to make up to the lower internal threads of the housing member after the internal slip mechanism has received the pin.

* * * * *